US005131705A

United States Patent [19]

Glück et al.

[11] Patent Number: 5,131,705

[45] Date of Patent: Jul. 21, 1992

[54] DEVICE FOR REMOTE-CONTROLLED GRASPING AND COUPLING

[75] Inventors: Karsten Glück, Hassel; Klaus Blaseck, Ehlershausen, both of Fed. Rep. of Germany

[73] Assignee: Deutsche Gesellschaft fur Wiederaufarbeitung von Kernbrennstoffen mbH, Hanover, Fed. Rep. of Germany

[21] Appl. No.: 507,785

[22] Filed: Apr. 12, 1990

[30] Foreign Application Priority Data

May 2, 1989 [DE] Fed. Rep. of Germany ..... 3914523

[51] Int. Cl.[5] ..... B66C 1/34; H01R 13/629

[52] U.S. Cl. ..... 294/82.32; 294/86.4; 294/906; 439/372

[58] Field of Search ..... 294/82.32, 82.34, 110.1, 294/906, 86.4, 116, 86.26; 292/54, 238; 403/322; 24/648, 645, 634, 635; 439/180, 352, 372

[56] References Cited

U.S. PATENT DOCUMENTS

| | | | |
|---|---|---|---|
| 2,654,135 | 10/1953 | Grizzard et al. . | |
| 2,724,093 | 11/1955 | Preston | 439/310 |
| 2,942,903 | 6/1960 | Giladett | 294/82.32 X |
| 3,240,520 | 3/1966 | Dailey et al. | 294/82.32 X |
| 3,976,347 | 8/1976 | Cooke, Sr. et al. . | |
| 4,174,875 | 11/1979 | Wilson et al. | 439/352 |
| 4,199,210 | 4/1980 | Trott | 294/86.26 X |
| 4,761,823 | 8/1988 | Fier | 439/352 X |
| 4,810,017 | 3/1989 | Knak et al. | 294/82.32 X |
| 4,828,510 | 5/1989 | Muzslay | 439/352 |
| 4,904,201 | 2/1990 | Pelletier | 439/352 |
| 4,993,967 | 2/1991 | Matsumoto | 439/352 X |

FOREIGN PATENT DOCUMENTS

| | | | |
|---|---|---|---|
| 1267941 | 6/1961 | France . | |
| 1274626 | 9/1961 | France . | |
| 2282580 | 3/1976 | France . | |
| 2214158 | 8/1989 | United Kingdom | 294/82.32 |

*Primary Examiner*—Johnny D. Cherry
*Attorney, Agent, or Firm*—Cushman, Darby & Cushman

[57] ABSTRACT

Apparatus for the remote grasping and safe transporting of an article and for remote coupling of an electrical plug connection comprises a first adapter device which is suitable for connection to a crane block and includes at least one load latch, adapted to be locked by a locking device, as well as a centrally arranged first plug member. It further comprises a second adapter device which is suitable for connection to an article to be transported and includes a pin member, adapted to be engaged with the load latch, as well as a second plug member disposed centrally within the pin member.

7 Claims, 2 Drawing Sheets

DEVICE FOR REMOTE-CONTROLLED GRASPING AND COUPLING

BACKGROUND OF THE INVENTION

1. Field of the Invention

The present invention relates to a means for the remote grasping and safe transporting of an article and for remote coupling of an electric plug connection.

2. Description of the Prior Art

The present invention particularly relates to the remote-controlled grasping and safe transporting of a tool and the simultaneous remote-controlled coupling of an electrical plug connection for the tool, performed exclusively by the vertical movement of a block of a crane hook. The tool will then be used in such zones of nuclear plants which do not allow the entry of personnel because of the hazardous environment.

A means for the remote grasping and safe transporting of a tool and for the remote coupling of an electric plug connection for power supply to the tool has been disclosed in the applicant's earlier German patent application No. P 38 15 033.6 which is not a prior publication. This means substantially comprises a first plug member fastened to a crane hook block, a second plug member disposed at the tool opposite the first plug member, a crane hook mounted on the crane hook block, and a retainer device provided at the tool for engagement with the crane hook. The retainer device and the crane hook, on the one hand, and the two plug members, on the other hand, are spaced apart in a direction transverse to the hoisting movement of the crane hook block. The coupling procedure of the electrical plug connection may give rise to undesirable moments. Moreover, the arrangement described according to the applicant's earlier application requires certain space which is not always available.

A means for remote coupling of an electric plug connection for use in nuclear plants is known from German Pat. No. DE-PS 26 28 865. It operates by means of gripping devices which are opened and closed by a drive motor acting through spindles and spindle nuts. The electrical connection is established by a multi-pole switch provided with a plurality of plug and socket contacts. The remote coupling of the electric plug connection requires additional handling means, such as electromechanical manipulators and active coupler systems and the like. The use of active coupler systems in turn requires additional servo drive means, such as feed spindles which again need to be supplied with power. That makes it necessary to provide a great number of individual leads in the cable duct and has an adverse effect on the cable storage dimensions. The reliability of the overall system suffers from the additional drive means.

It has become quite customary in nuclear plants to carry out remote controlled operations on working tools by means of a crane. A crane hook may be employed to grasp a great variety of working implements, to convey them to their job site, and to hold them in proper position during operation. A crane hook also may be used to take up and transport parts needing to be exchanged. Such a crane system for remote handling is extremely sturdy, easy to manipulate, and adaptable to the most diverse tasks. The only difficulty with this system is the making and breaking of electrical connections between power supply units, control lines, and the like as well as taking up, gripping, and safely conveying articles, such as electrical tools by the crane.

In contrast to the prior art discussed, the object of the present invention provides a means for the remote grasping and safe transporting of an article and for remote coupling of an electric plug connection. In addition to being easy to handle, it still meets the high demands of reliability, for instance, in the field of remote controlled operations in nuclear plants.

SUMMARY OF THE INVENTION

Accordingly it is an object of the present invention to conduct remote grasping and safe transporting of an article and remote coupling of an electric plug connection.

The design according to the present invention comprises a first adapter device which is connected to a crane block, has a load latch locking mechanism, and includes a central plug member, as well as a second adapter device which is connected to the article to be conveyed, preferably an electrical tool, and includes a pin member adapted for engagement with the load latch as well as a second plug member disposed centrally within the same.

This design provides a structure that is both sturdy and compact and prevents the undesirable occurrence of moments when the electric plug connection is being coupled together. As the first plug member is located within the first adapter device, this adapter device acts as a mechanical protector of the first plug member. Furthermore, as the second plug member is located within the pin member of the second adapter device, the second plug member is protected against any mechanical damage. And as the overall structure can be made so as to be substantially of rotationally symmetrical configuration, the centering is easy and the coupling of the plug connection, as well as the mutual latching of the two adapter parts, is effected without causing any moments.

It is an essential aspect of the invention that it is possible to obtain the catching of the first adapter device at the second adapter device by the load latch and the locking by the locking device, as well as the simultaneous coupling of the first plug member to the second plug member to establish the electric plug connection by no more than aligning and subsequently vertically moving the crane hook block. The connection is made between the two adapter devices and the plug connection established between the two plug members by lowering the crane hook block, together with the first adapter device secured to the same, with respect to the second adapter device until at least one load latch of the first adapter device is connected with the pin member of the second adapter device and is locked in that position by the locking device. The plug-in connection of the two plug members is made by the vertical relative movement of the two adapter devices with respect to each other. The subsequent lifting of the crane block will remove the second adapter device, to which, preferably, an electrical tool is attached, from its mounting and bring it to its place of work. As will become apparent from the description below that design likewise permits an easy separation of the two adapter devices from each other. This is obtained substantially by vertical movement of the crane hook block and the assistance of a storage device of suitable structure for the second adapter device.

Furthermore, the locking device is embodied by a displaceable element which is movable under gravity into a lower position, starting from an upper position. At least one load latch is pivoted into an elevated pivot position when the first adapter device is separated from the second adapter device. The displaceable element in its lower position locks at least one load latch in an elevated pivot position by form-lock engagement with said latch. Automatic shifting, caused by gravity, of the displaceable element into its lower position for locking the load latch in the upper pivot position, in which the two adapter devices are interlocked in formlock, is accomplished by this design.

A particularly simple structure is obtained with a substantially rotationally symmetric design of the means with which the first adapter device is realized in the form of a latch hood having a substantially cylindrical outer surface, and the displaceable element is designed as a displaceable ring adapted to be shifted in a vertical direction on the cylindrical outer surface. The load latch, when in its lower pivot position which it preferably adopts under gravity, projects in a radial direction beyond the cylindrical outer surface, while it does not project beyond the cylindrical outer surface when in its upper pivot position. It thereby permits the displaceable ring to drop into the locking position.

Preferably, the load latch is kept in its lower pivot position by a stop member. A fixed starting position of the load latch defined as the pin member is first introduced. Proper configuration both of the pin member and the load latches permits automatic compensation of mutual axial offsets of the two adapter devices during the procedure of introducing the pin member.

According to another modification, the pin member comprises a guiding sleeve which is radially spaced from the second plug member it surrounds. The guiding sleeve passes over into a frustoconical run-up surface provided at a holding collar which enters into engagement with the load latch in the upper pivot position thereof. This configuration of the pin member assures its automatic centering when it is being introduced into the area between the load latches, the second plug member being protected mechanically by the guiding sleeve so as not to be damaged. As the pivoting of the load latches increase, the transition from the run-up surface into the holding collar causes an increasingly more accurate axial alignment of the two adapter devices. In the upper arrested position of the load latches, the surfaces mentioned also form part of the formlock engagement between the load latch and the pin member.

According to another embodiment of the invention, the pin member is provided with a storage collar by which the second adapter device, when uncoupled from the first adapter device, can be placed on a storage device.

A shockproof structure which does not permit live ring contact parts to be touched and which is protected against any mechanical damage is obtained, when the first adapter device comprises a centering sleeve which encloses a ring contact socket and has a smaller outer diameter than the inner diameter of the guiding sleeve, and the secong plug member is a ring contact plug.

As already mentioned, the second adapter device is preferably connected to an electrical tool.

Preferably, the locking device is of such design that it can be shifted, against gravity, into its upper position when the second adapter device is deposited on the storage device. That cancels the locking by the load latch.

BRIEF DESCRIPTION OF THE DRAWINGS

A preferred embodiment of the invention for the remote grasping and safe transporting of an article and for remote coupling of an electric plug connection and a preferred embodiment of a storage device for the second adapter device will be described below with reference to the accompanying drawings, in which.

DETAILED DESCRIPTION OF THE PREFERRED EMBODIMENTS

Figure 1:
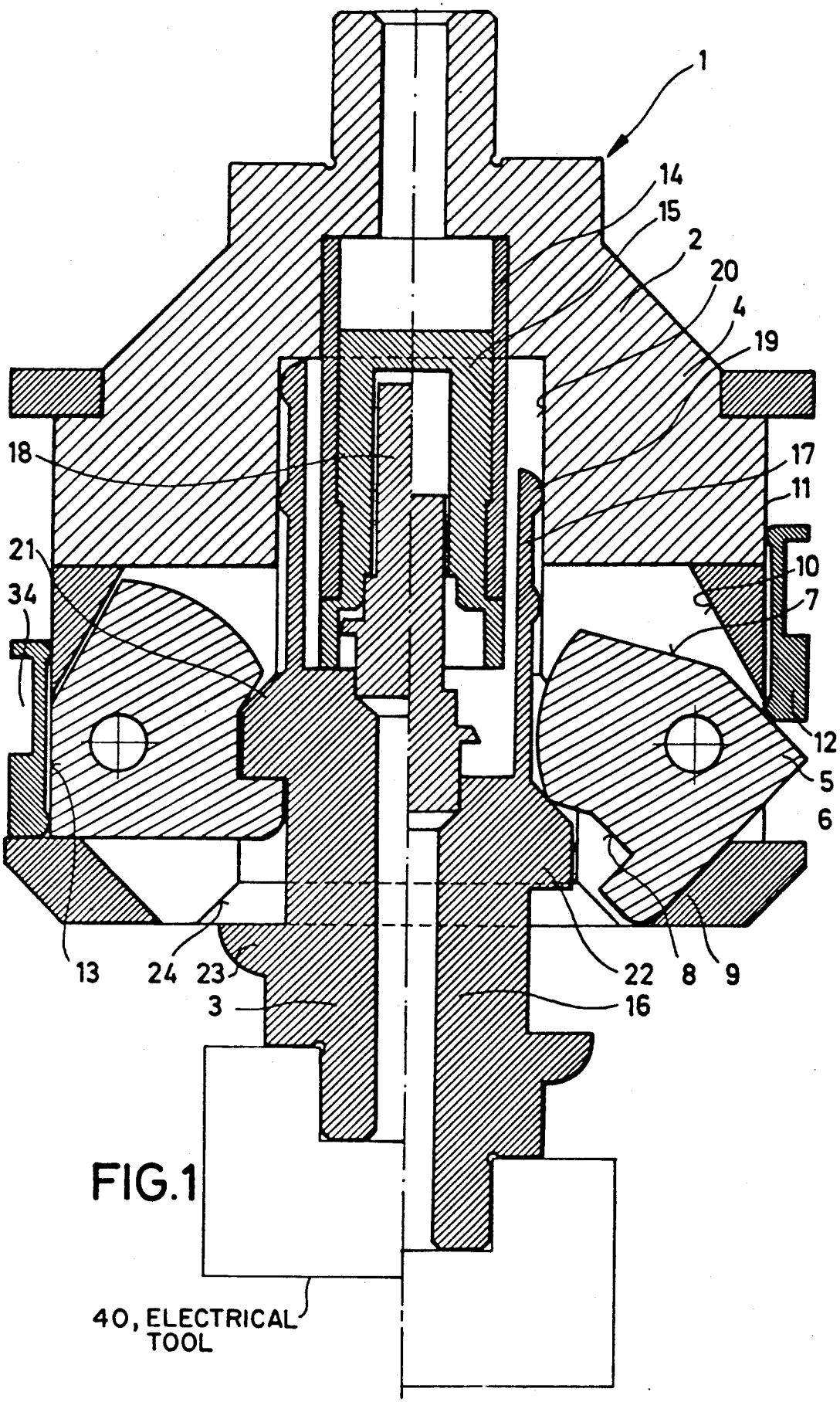
FIG. 1 is a cross sectional elevation of a preferred embodiment, the left side in FIG. 1 showing a locked condition of engagement of the parts and the right side an unlocked condition.

The embodiment of the present invention for the remote grasping and safe transporting of an article and for remote coupling of an electric plug connection shown in FIG. 1 is designated, generally, by reference numeral 1. It comprises a first adapter device 2 and a second adapter device 3. The first adapter device 2 includes a latch hood 4 in which preferably three load latches 5 are arranged for pivotal movement. At its upper end in FIG. 1 the first adapter device 2 is linked to a crane block (not shown). Each of the load latches 5 has a lower abutment surface 6, an upper abutment surface 7 and a recess 8. When in its lower pivot position, the load latch 5 has its lower abutment surface 6 in engagement with a lower stop member 9. In the upper pivot position, on the other hand, the upper abutment surface 7 lies against an upper stop member 10. In the lower pivot position, the outer part of the load latch, in the radial direction of the latch hood 4, projects beyond a cylindrical outer surface 11 of the latch hood 4, thus presenting a support for a displaceable ring 12 to rest upon. The displaceable ring 12 extends around the cylindrical outer surface 11 of the latch hood 4 and is movable with respect to the same in a vertical direction (cf. the right side in FIG. 1).

When the load latch 5 is in its upper pivot position, shown at the left in FIG. 1, it does not project beyond the cylindrical outer surface 11 of the latch hood 4. Consequently, the load latch 5 in this pivot position no longer presents a support for the displaceable ring 12 which thus can slide under gravity into a lower position in a vertical direction. In this position the displaceable ring locks the load latches 5 in their upper pivot position by entering into form lock engagement with rear abutment surfaces 13 of the same.

The first adapter device 2 further comprises a centering sleeve 14 which surrounds a ring contact socket 15.

The second adapter device 3 which is firmly joined to the electrical tool 40 that is adapted for remote handling, comprises a pin member 16 formed in its upper part with a guiding sleeve 17 which is radially spaced from and surrounds a ring contact plug 18 disposed centrally in the guiding sleeve 17. The inner diameter of the guiding sleeve 17 is greater than the outer diameter of the centering sleeve 14. The guiding sleeve 17 is crowned at least at its upper end 19 so as to cause its centering upon being introduced into the bore 20 of the latch hood 4. At the foot of the guiding sleeve 17 the pin member 16 passes over into a frustoconical run-up surface 21 which is followed by a holding collar 22. When the pin member 16 is fully inserted and the load latches 5 are in their upper pivot position, the holding collar 22 engages in the recesses 8 formed in the load latches 5.

The pin member 16 is further formed with a storage collar 23, the diameter of which increases from a lower to an upper region thereof. As will be explained below with reference to FIGS. 2 and 3, this storage collar serves to deposit the second adapter device 3, when uncoupled from the first adapter device 2, on a storage device.

It is evident from the description of the structure of the embodiment shown in FIG. 1 that upon lowering the first adapter device 2 with respect to the second adapter device 3, first the upper end 19 of the guiding sleeve is given some initial centering by a lower conical entrance aperture 24 in the latch hood 4. Further centering is affected by the gliding engagement with the load latches 5 before the crowned upper end 19 of the guiding sleeve 17 slides into the bore 20 and the run-up surface 21 enters into engagement with the upper area, as seen at the right in FIG. 1, of the recess 8 formed in the load latch 5. As the latch hood 4 is lowered further, the pivoting motion of the load latches 5 results in their engagement with the holding collar in the area of their recesses 8. Thus finally engagement is established in the areas mentioned when the upper abutment surface 7 of the load latches 5 comes to rest against the upper stop members 10. When in this position, the displaceable ring 12 drops into its lower position which is illustrated in the left half of FIG. 1, and causes the locking already described of the load latches 5 in their upper pivot position. The adapter devices 2, 3 are thereby interlocked and, in this condition, the two plug members, namely the ring contact plug 18 and the ring contact socket 15, are electrically coupled.

Merely looking at the embodiment of FIG. 1, a person skilled in the art will realize that the first adapter device 2, when interlocked with the second adapter device 3, can be separated from the latter only if first the locked load latches 5 are released by raising the displaceable ring 12. That requires a separate device which will be explained below with reference to FIGS. 2 and 3.

Figure 2:
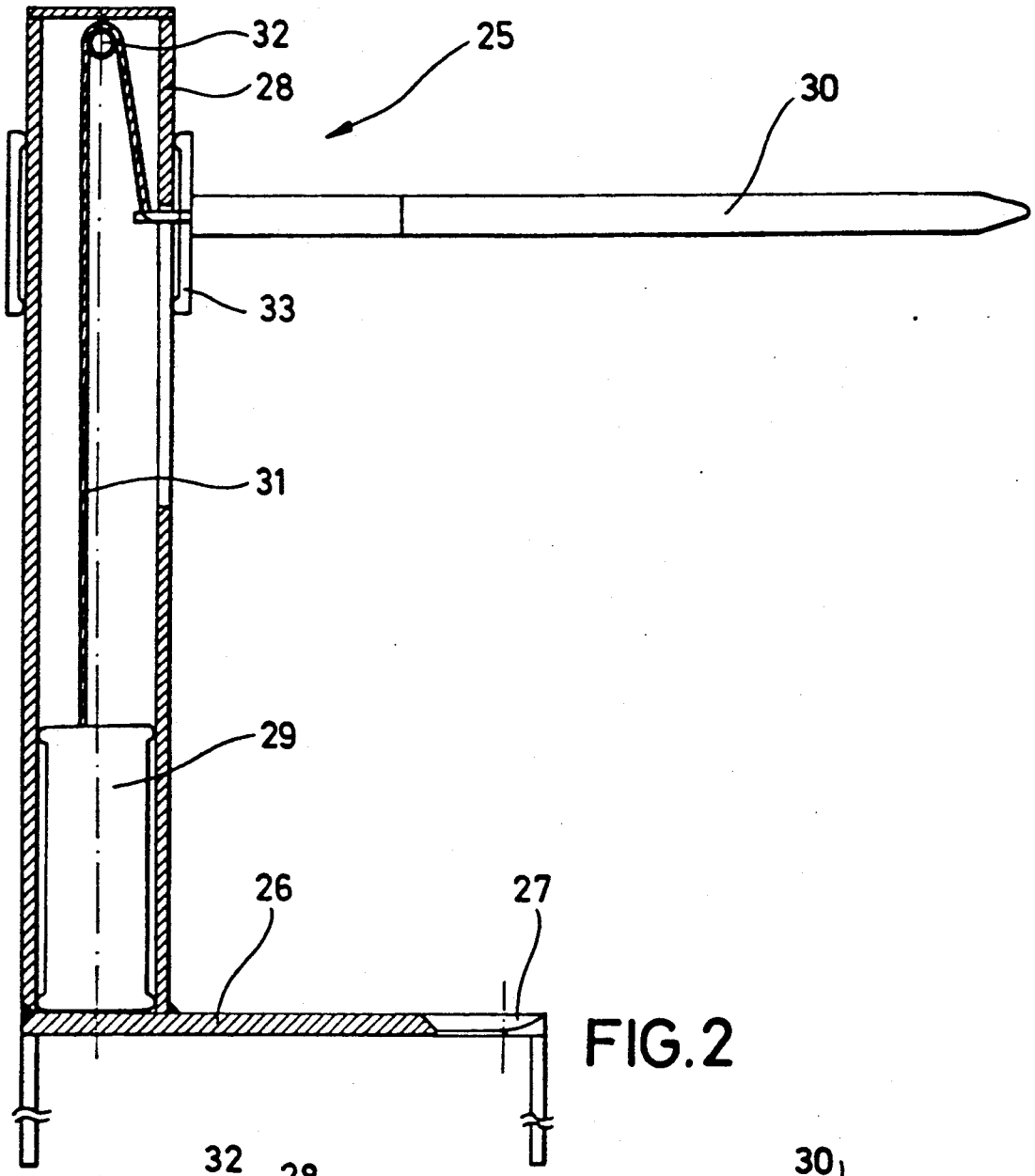
FIG. 2 is a sectional elevation of an embodiment of a storage device for a second adapter device.
Figure 3:
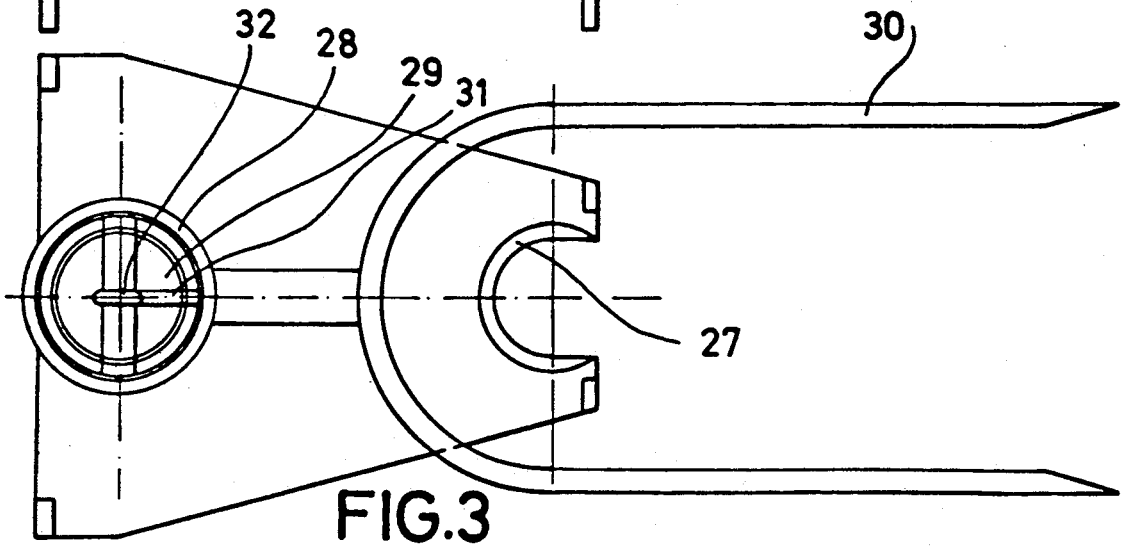
FIG. 3 is a top plan view of the storage device shown in FIG. 2.

The storage device 25 shown in a vertical sectional elevation in FIG. 2 and in top plan view in FIG. 3 is generally designated by reference numeral 25. It comprises a deposit rack 26 having a plurality of tool deposit hollows 27 to receive a plurality of tools which are to be coupled alternatively. Each tool deposit hollow 27 is adapted in shape to the storage collar 23 of the second adapter device 3. The deposit rack 26 is provided with an upright guide tube 28 for each tool (not shown) to be deposited and a counterweight 29 for a substantially U-shaped fork 30 being guided in the guide tube. The fork 30 is connected to the counterweight 29 by a wire rope 31 passing around a guide pulley 32. The U-shaped fork 30 is supported for vertical displacement along the guide tube 28 by means of a guide bushing 33. As may be seen in FIG. 1, the displaceable ring 12 is formed with a circumferential groove 34, the outer diameter of which substantially conforms to the inner diameter of the fork 30.

To unlock the two adapter devices 2, 3 from each other, the groove 34 of the displaceable ring 12 is moved to engage the fork 30 of the storage device 25 by horizontally shifting the crane hook block. Thereupon downward movement of the crane block will lower the means 1 until the storage collar 23 of the second adapter device 3 rests in the tool deposit hollow 27 of the deposit rack 26, thereby relieving the load latches 5. By means of the weight of the counterweight 29, the fork 30 causes the displaceable ring 12 to be shifted into its upper stop position. Now the relieved load latches 5 can fall by gravity into their lower pivot position, releasing the pin member 16. The subsequent lifting of the crane block will separate the first adapter device 2 from the second adapter device 3, and horizontal displacement to the right in FIG. 2 will separate the fork 30 from the displaceable ring 12. Then the first adapter device 2 is ready to receive another tool from the magazine-type deposit rack 26.

Although the means according to the invention was described with reference to a particular case of application of the remote handling technique in nuclear installations, the field of application of the means according to the invention is not limited to such installations. Instead, it comprises any application where it is desired to take up an article by remote handling and to establish a connection for signal transmission or power supply.

What is claimed is:

1. Apparatus for remote controlled grasping and safe transporting of an article and for remote coupling of an electric plug connection, comprising:

a first adapter device connectable to a crane block and including a first, centrally disposed contact member, at least one pivotable load latch and a locking device;

a second adapter device connectable to the article to be transported and including a pin member and a second contact member disposed centrally within said pin member, said load latch engaging said pin member and said first contact member engaging said second contact member when said first and second adapter devices are brought into contact;

said load being pivotable between a lower pivot position in which said load latch does not engage said pin member and an elevated pivot position in which said load latch does engage said pin member to interconnect said first and second adaptor devices, gravity urging said load latch toward said lower pivot position;

said locking device including a displaceable element which is movable under gravity from an upper position when said load latch is in said lower pivot position, to a lower position, as said load latch is pivoted into said elevated pivot position, said displaceable element, in its lower position, locking said load latch in said elevated pivot position to lock said first adapter device to said second adapter device; and a storage device including a fork, said locking device including a circumferential groove to be grasped by said fork of said storage device for shifting said locking device, against gravity, into said upper position in which said load latch is unlocked from said pin member and said first adapter device is released from said second adapter device.

2. Apparatus as claimed in claim 1 wherein:

said first adapter device is designed includes a latch hood, having a substantially cylindrical outer surface, that ;

said displaceable element includes a displaceable ring adapted to be shifted in a vertical direction on said cylindrical outer surface; and said load latch projects, in a radial direction of said latch hood, beyond said cylindrical outer surface thereof when in said lower pivot position, while it does not project beyond the cylindrical outer surface when in said elevated pivot position.

3. Apparatus as claimed in claim 1 or 2, wherein said load latch is retained in said lower pivot position by a lower stop member which engages with a lower abuttment surface of said load latch.

4. Apparatus as claimed in claim 1 or 2, wherein said pin member comprises a guiding sleeve which is radially spaced from and surrounds said second contact member and which passes over into a frustoconical run-up surface provided at a holding collar which enters into engagement with said load latch in said elevated pivot position thereof.

5. Apparatus as claimed in claim 1 or 2, wherein said pin member includes a storage collar by which said second adapter device, when uncoupled from said first adapter device, can be place on said storage device.

6. Apparatus as claimed in claim 4, wherein:

said first contact member includes a first ring contact socket;

said first adapter device includes a centering sleeve which encloses said first ring contact socket and has a smaller outer diameter than the inner diameter of said guiding sleeve; and said second contact member is a second ring contact plug.

7. Apparatus as claimed in claim 1 or 2, wherein said second adapter device is attached to an electrical tool.

* * * * *